US007071903B2

(12) United States Patent
Mizohata et al.

(10) Patent No.: US 7,071,903 B2
(45) Date of Patent: Jul. 4, 2006

(54) MULTIPLEX ANODE MATRIX VACUUM FLUORESCENT DISPLAY AND THE DRIVING DEVICE THEREFOR

(75) Inventors: Tadashi Mizohata, Chiba (JP); Minoru Hiraga, Chiba (JP)

(73) Assignee: Futaba Denshi Kogyo Kabushiki Kaisha, Chiba (JP)

( * ) Notice: Subject to any disclaimer, the term of this patent is extended or adjusted under 35 U.S.C. 154(b) by 449 days.

(21) Appl. No.: 10/425,319

(22) Filed: Apr. 29, 2003

(65) Prior Publication Data

US 2003/0193455 A1 Oct. 16, 2003

Related U.S. Application Data

(62) Division of application No. 09/557,355, filed on Apr. 24, 2000, now abandoned.

(30) Foreign Application Priority Data

Apr. 22, 1999 (JP) ..... 11-114417

(51) Int. Cl.
*G09G 3/20* (2006.01)
*G09G 3/22* (2006.01)

(52) U.S. Cl. ..... 345/75.1; 345/74.1

(58) Field of Classification Search ..... 345/74.1, 345/75.1, 103, 204; 313/496
See application file for complete search history.

(56) References Cited

U.S. PATENT DOCUMENTS

| | | | | |
|---|---|---|---|---|
| 4,149,147 | A | | 4/1979 | Kishino |
| 4,868,555 | A | * | 9/1989 | Watanabe et al. ..... 345/75.1 |
| 4,885,628 | A | | 12/1989 | Nagai et al. |
| 5,541,478 | A | * | 7/1996 | Troxell et al. ..... 313/497 |
| 5,739,634 | A | | 4/1998 | Kinoshita et al. |
| 5,844,531 | A | * | 12/1998 | Betsui ..... 345/74.1 |
| 6,025,821 | A | | 2/2000 | Mart |

* cited by examiner

*Primary Examiner*—Ricardo Osorio

(57) ABSTRACT

A multiplex anode matrix fluorescent display capable of allowing a duty cycle thereof to be multiple times that of the prior art multiplex anode matrix fluorescent display is provided without changing the structure of the prior art multiplex anode matrix fluorescent display.

9 Claims, 8 Drawing Sheets

MULTIPLEX ANODE MATRIX VACUUM FLUORESCENT DISPLAY AND THE DRIVING DEVICE THEREFOR

This application is a divisional of pending application Ser. No. 09/557,355 filed Apr. 24, 2000 now abandoned.

FIELD OF THE INVENTION

The present invention is related to a multiplex anode matrix fluorescent display; and, more particularly, to a multiplex anode matrix fluorescent display for use in a graphic display and a driving device therefor.

DESCRIPTION OF THE PRIOR ART

A fluorescent display is used in a graphic display capable of displaying characters and/or patterns, wherein a large number of segments are very densely arranged in the row and column directions. The fluorescent display includes anode electrodes, each forming a segment and being coated with a phosphor layer for emitting light by the bombardment of electrons emanated from a cathode filament, and grid electrodes for controlling acceleration of the colliding electrons. In order to reduce the gap between the segments, the spacing between grid electrodes arranged above the segments should also be reduced. However, if the spacing between grid electrodes are reduced, the negative voltage applied to neighboring grid electrodes affects the space electric field, to thereby inwardly deflect electrons reaching the anode electrode from the cathode filament, and thus prevent the electrons from being uniformly distributed when they are bombarded onto the anode electrodes. As a result, there may occur broken characters or patterns on the displayed image and the displaying quality will be deteriorated.

In order to remedy the shortcomings caused by the high density arrangement described above, an anode fluorescent display has been developed in the form of a triplex, a quadruple, an octuple or the like. In such a multiplex anode matrix fluorescent display, while sequentially driving two neighboring grid electrodes, the two being driven simultaneously, an electric signal corresponding to a display data is applied to one half of anode electrode columns located at a central portion of an area formed by aligning adjacent grid electrodes. And thus, it prevents the potential applied to the adjacent grid electrodes from affecting the display quality.

FIG. 7 is an exemplary diagram showing a conventional quadruple anode matrix vacuum fluorescent display. In the drawing, a reference numeral 1 represents a grid terminal, a reference numeral 2 stands for a grid electrode and a reference numeral 3 illustrates an anode electrode having a phosphor layer. The anode electrode 3 is arranged in the form of m×4n matrix, m and n being predetermined integer. In the direction of row, a multiplex anode group is constructed in a plurality of columns formed with a plurality of groups, each group formed by 4 adjacent anode electrodes. Anode electrodes 3 constituting each group are assigned with 1 to 4, respectively, for representing an arrangement position in the direction of row.

FIG. 8 is an exemplary diagram showing a pattern of anode wirings in the conventional fluorescent display shown in FIG. 7. Each anode electrode 3 having a same arrangement position 1–4 in the direction of row in each group is connected to a common anode terminal P by an anode wiring 4. The number of the anode terminals P is 4×m.

Referring back to FIG. 7, n columns of anode electrodes 3 constituting each group are divided in the row direction into a forward portion and a backward portion and a column of the grid electrode 2 is commonly arranged to each column of the anode electrode 3. The grid electrode 2 is in the form of mesh; each grid electrode 2 is connected to a grid terminal 1.

Under the condition that the adjacent two grid electrodes 2 are selected simultaneously, grid electrodes 2 are sequentially switched in the right direction by column by column and a driving voltage is applied from each grid terminal 1 to the selected two columns of grid electrodes 2. A driving voltage corresponding to the displaying data is supplied to one half of anode electrodes 3 located at a central portion of an area corresponding to the selected adjacent grid electrodes. Specifically, displaying data corresponding to a position of each segment are supplied to the anode electrodes connected to each of the arrangement numbers 1, 4 or anode electrodes connected to each of the arrangement numbers 2, 3.

In the example as shown, hatched segments represent turned on segments. Adjacent grid electrodes having numbers 3G, 4G are on and the other grid electrodes are off. If a voltage is applied to the anode electrodes 3 having arrangement numbers 2, 3 to turn on the segment, the half number of segment dots, located at the central portion in the area of the two grid electrodes 2 which are turned on by the grid voltage, will be turned on.

Subsequently, if the grid voltage applied on adjacent grid electrode numbers 4G, 5G, is turned on and voltages on the other grid electrodes are turned off, thereby applying a voltage to anode electrodes having arrangement numbers 4, 1, the segments with the arrangement numbers 4, 1, which are adjacent on the right to the anode electrodes 3 having the arrangement numbers 2, 3 that are currently turned on, will be turned on.

In the quadruple anode matrix fluorescent display described above, two columns of segment are turned on in a single cycle of dynamic display and at the same time the effect on the display quality from the potential applied to adjacent grid electrodes is reduced. That is, a duty cycle (i.e., a duty ratio) of the quadruple anode matrix fluorescent display becomes equal to two times that of a single anode matrix fluorescent display. Thus, the quadruple anode matrix fluorescent display can produce brightness equal to two times that of a single anode matrix fluorescent display.

FIG. 9 is an exemplary diagram showing lighting segments in a conventional octuple anode matrix fluorescent display. In the drawing, a reference numeral 41 is a grid terminal, a reference numeral 42 is a grid electrode and reference numeral 43 is an anode electrode having a phosphor layer. Anode electrode 43 is arranged in the form of a matrix of m rows and 8n columns of segments, m and n being predetermined integer. In the direction of row, a plurality of anode groups having multiple columns is constructed by grouping eight adjacent anode electrodes 43 as one group. The anode electrodes 43 in each group are assigned to numbers 1 to 8, respectively, to represent an arrangement position.

FIG. 10 is an exemplary diagram showing a pattern of anode wirings in the octuple anode matrix fluorescent display shown in FIG. 9. In the drawing, a reference numeral 44 is an anode wiring. In each of the groups, anode electrodes 43 at same arrangement positions 1 to 8 in the direction of row are connected to respective common anode terminals ($P_1$~$P_{(8\times m)}$) of each row of segments by a multiple lines of anode wirings 44.

Referring back to FIG. 9, 8n columns of anode electrodes 43 constituting n groups are divided in the row direction into forward portion and backward portion in each group and grid electrodes 42 are allocated to each portion. A grid terminal 41 is connected to each grid electrode 42.

Under the condition that the adjacent grid electrodes 42 are selected simultaneously, selected grid electrodes 42 are sequentially switched in the right direction one by one and a driving voltage is applied from each grid terminal 41 to the two selected grid electrodes 42. In the example as shown, grid voltages of the adjacent grid electrode numbers 2G, 3G are turned on and the other grid terminals are turned off. If a voltage to turn on the segment is supplied to the columns of anode electrodes 43 located at a central portion of an area corresponding to the selected grid electrodes 42, i.e., each of the arrangement number 7, 8, 1, 2 of anode electrodes 43 in the above described example, a half number of segment dots in the central portion of an area of two grid electrodes 42, which are turned on, will be turned on to be displayed as shown.

Next, if grid voltages of the adjacent grid electrode numbers 3G, 4G are turned on while the other grid electrodes are turned off and a voltage to turn on the segment is applied to the arrangement number 3, 4, 5, 6 of the anode terminals, the arrangement number 3, 4, 5, 6 of the segment adjacent to the currently displaying segments will be displayed.

In the octuple anode matrix fluorescent display described above, four columns of segments can be simultaneously turned on in a single cycle of dynamic display and at the same time the effect on the display quality from the potential applied to adjacent grid electrodes is reduced. In other words, a duty cycle (i.e., a duty ratio) of the octuple anode matrix fluorescent display becomes equal to four times that of a single anode matrix fluorescent display, thereby producing brightness equal to four times that of a single anode matrix fluorescent display.

As the number of multiplex increases, the number of the grid electrodes is reduced, which will, in turn, increase the duty cycle. Thus, although the number of segments is same, a same brightness of display can be obtained with lower grid voltage. If the grid voltage can be reduced to a lower value, the voltage of the power supply circuit need not be high, and therefore, the multiplex anode matrix display can be preferably utilized in a graphic display for use in a mobile. And at the same time, since a driver having a low withstand voltage can be used in driving the grid electrode, the cost of the driver can be reduced.

However, as the number of the multiplex increases, the number of wirings between segment dots in the segment pattern area increases. Since there is a limitation on a wiring width, there is a limit on reducing the pitches between segment dots. Therefore, in order to increase the number of segments, the size of the fluorescent display must be enlarged, which is not compatible to the trend for the miniaturization of the display device. In other words, if the number of the wiring in the fluorescent display is reduced to realize the miniaturization thereof, it can no longer take advantage of low grid voltage by increasing the number of multiplex.

SUMMARY OF THE INVENTION

In order to overcome the aforementioned drawback of the conventional multiplex anode matrix fluorescent display, a primary object of the present invention is to provide a multiplex anode matrix fluorescent display capable of allowing a duty cycle thereof to be multiple times that of the prior art multiplex anode matrix fluorescent display without changing the structure thereof and a driving device therefor.

In accordance with the present invention described in claim 1, there is provided a multiplex anode matrix fluorescent display comprising: a plurality of anode electrodes and a multiple of grid electrodes arranged in the form of matrix; wherein the grid electrodes are arranged in such a way that k column of the anode electrodes corresponds to a grid electrode, k being an even positive number; and the anode electrodes and the grid electrodes are divided into a number of regions in the direction of row, and the plurality of anode wirings in the form of the multiplex anode matrix is formed on each of the regions.

Therefore, the duty cycle becomes multiple times that of the prior art case without changing the structure of the prior art multiplex anode matrix fluorescent display since the columns of the segments to be displayed simultaneously increase by multiple times in proportional to the number of the plurality of regions described above.

In accordance with the present invention described in claim 2, the multiple anode matrix fluorescent display according to claim 1, comprises a plurality of grid wirings and a plurality of grid terminals, the grid wirings connecting the grid electrodes located at a same position in each of the regions based on a forward direction or a backward direction arrangement to a common of the grid terminals.

Therefore, since the grid electrodes to which grid drive pulses need be applied synchronously to the same scan timing are connected to a common of the grid terminals, it is easy to arrange the wirings for supplying grid drive pulses from the driving device to each of the grid electrodes.

In accordance with the present invention described in claim 3, the multiple anode matrix fluorescent display according to claim 1, comprises a plurality of grid wirings, a plurality of grid terminals and a jump line, the grid wirings being connected to the plurality of columns of the grid electrodes as well as connecting the grid electrodes located at a same position in each of the regions based on a forward direction or a backward direction arrangement to a common of the grid terminals, respectively.

Therefore, similar to the invention described in claim 2, it is easy to arrange the wirings for supplying grid drive pulses from the driving device to each of the grid electrodes.

In accordance with the present invention described in claim 4, the multiple anode matrix fluorescent display according claim 1, comprises a plurality of control drivers to apply driving voltages for use in scanning to each of the grid electrodes, the control drivers being provided in each of the regions to each of the anode electrodes and each of the grid electrodes, respectively with applying driving voltage according to displaying data to each of the anode electrodes.

As a result of the formation of the anode wiring pattern of the multiple anode matrix fluorescent display in each of the regions, although the number of the anode electrodes to independently apply anode drive voltages based on displaying data at the same time, since the fluorescent display has a separate control driver for each of the anode electrodes and each of the grid electrodes in each of the regions, it is easy to apply anode drive voltages to the anode electrodes.

In accordance with the present invention described in claim 5, a multiplex anode matrix fluorescent display including a plurality of anode electrodes and a multiple of grid electrodes arranged in the form of matrix, the grid electrodes being arranged in such a way that k columns of the anode electrodes correspond to each grid electrode, k being an even positive number, and the anode electrodes and the grid electrodes being divided into a number of regions in the direction of row, and the plurality of anode wirings in the form of the multiplex anode matrix is formed on each of the regions, characterized in that the display comprises a grid driver and an anode driver, wherein the grid driver applies a driving voltage to adjacent grid electrodes in each of the regions by simultaneously scanning grid electrode by grid electrode in the direction of row, the anode driver drives a displaying of a plurality columns of the anode electrodes located at the two adjacent grid electrodes applied to the driving voltage in response to a displaying data, and, in the border line between each of the regions, when an end of a region of the grid electrode is driven and an end of a region of the anode electrode is driven at the same time, the grid driver and the anode driver make the scan cycles of the grid driving pulse in each region starts synchronous to drive other end of the region of the grid electrode and the other end of the anode electrode at the same time.

Therefore, the duty cycle increases by multiple times since the columns of the segments to be displayed simultaneously become multiple times in proportional to the number of the plurality of regions of the multiple anode matrix fluorescent display. In the adjacent border between each of the regions, the characters in the adjacent border do not broke during the display thereof since the display control is implemented in accordance with that of the prior art multiple anode matrix fluorescent display.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1A:
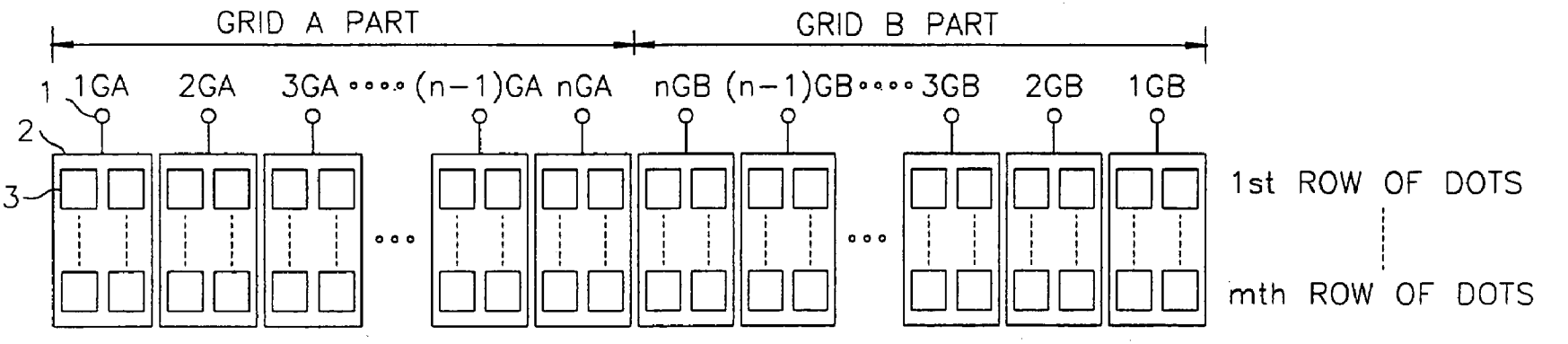
FIGS. 1A and 1B are exemplary diagrams showing arrangement of grids and anode patterns in a quadruple anode matrix vacuum fluorescent display as an embodiment of a multiplex anode matrix vacuum fluorescent display in accordance with the present invention.
Figure 1B:
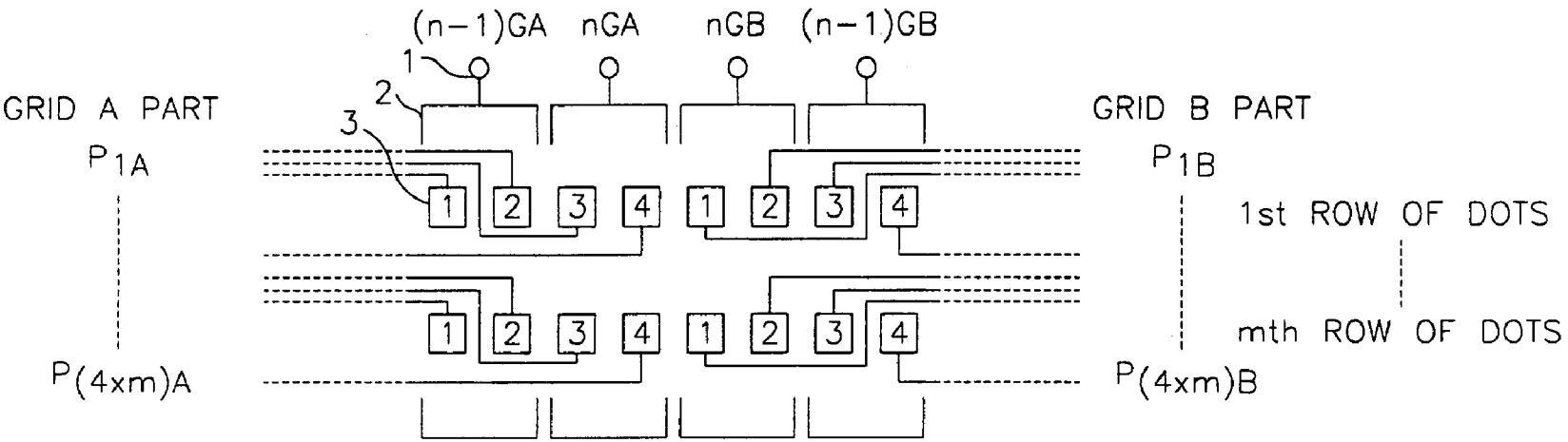

FIG. 1 is an exemplary diagram showing arrangement of grids and anode patterns in a quadruple anode matrix vacuum fluorescent display as an embodiment of a multiplex anode matrix vacuum fluorescent display in accordance with the present invention. FIG. 1A is a diagram showing the arrangement of the anode electrodes and grid electrodes. FIG. 1B is a diagram showing a wiring arrangement drawn from the anode terminals and the grid terminals. In the drawings, like parts appearing in FIGS. 7 and 8 are represented by like reference numerals.

As shown in FIG. 1A, a plurality of anode electrodes 3 is arranged in a matrix form. A column of a plurality of grid electrodes 2 is prepared to correspond to two (½ of the multiplex number) columns of a plurality of anode electrodes 3 and each anode electrode 3 and each grid electrode 2 are classified in the row direction into two areas to form anode wiring patterns in the form of quadruple anode matrix at each of the area, as shown in FIG. 1B.

Figure 7:
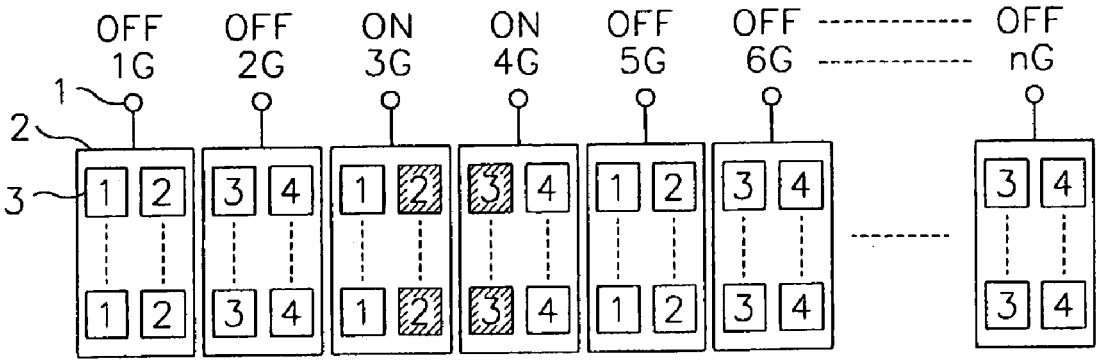
FIG. 7 (PRIOR ART)
FIG. 7 illustrates an exemplary diagram showing a conventional quadruple anode matrix vacuum fluorescent display.
Figure 8:
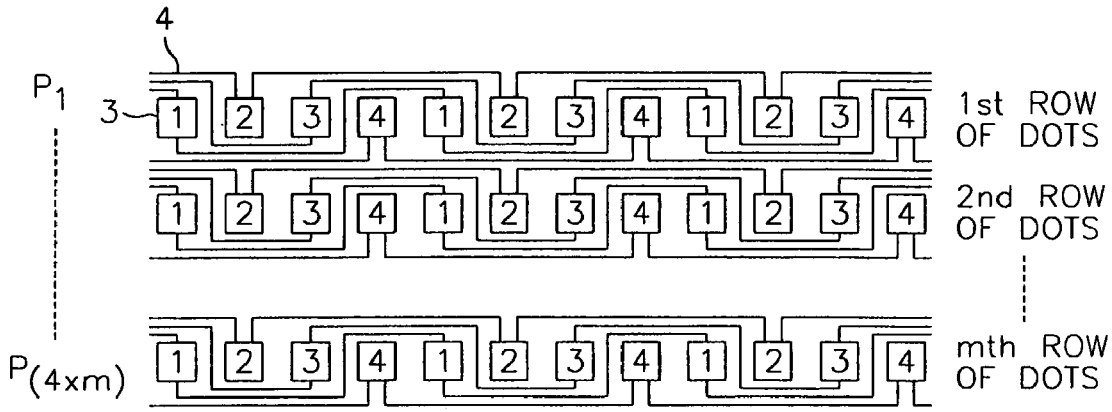
FIG. 8 (PRIOR ART)
FIG. 8 depicts an exemplary diagram showing a pattern of anode wirings in the conventional quadruple anode matrix vacuum fluorescent display shown in FIG. 7.
Figure 9:
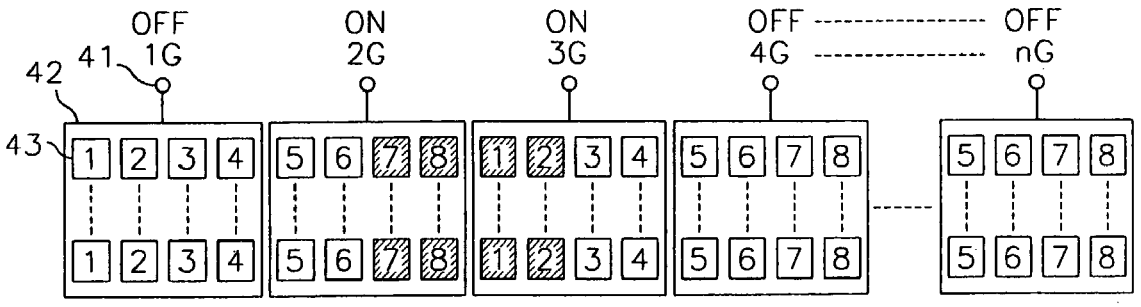
FIG. 9 (PRIOR ART)
FIG. 9 presents an exemplary diagram showing lighting segments in a conventional octuple anode matrix fluorescent display.
Figure 10:
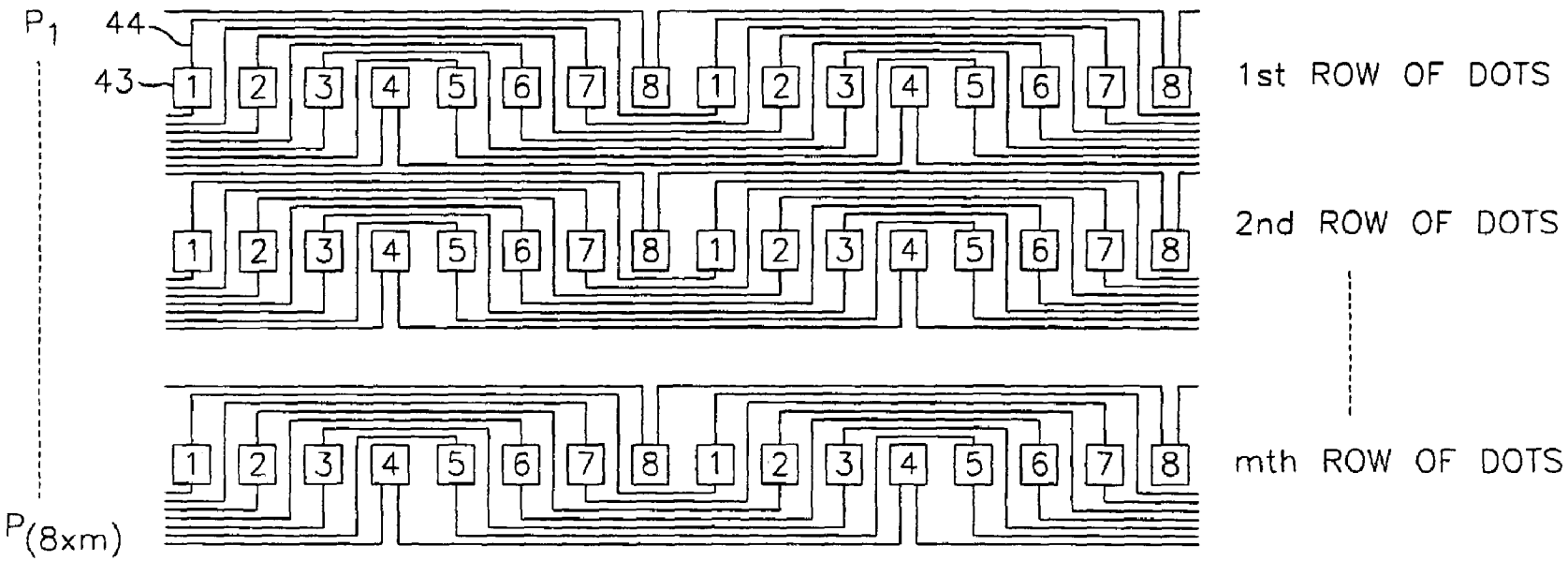
FIG. 10 (PRIOR ART)
FIG. 10 illustrates an exemplary diagram showing a pattern of anode wirings in the octuple anode matrix fluorescent display shown in FIG. 9.

And thus, the electrode structure and the size thereof are similar to those shown in FIG. 7 except that all segments are divided into adjacent two areas A, B in the direction of row. The front portion of the grid electrodes is named A part and the rear portion of the grid electrodes is named B part. Corresponding to this, grid electrodes are named 1GA~nGA, nGB~1GB from left to right in order, respectively, as shown in drawing and the way applying a driving voltage to the grid electrode 2 is changed.

Likewise, as shown in FIG. 1B, corresponding to the division of a plurality of anode electrodes into two areas A, B as described above, the left area A of the anode electrodes 3 is named an anode A part and the right area B of the anode electrodes 3 is named an anode B part. Common anode terminals $P_{1A}$~$P_{(4\times m)A}$ connecting each of the like arrangement numbers 1 to 4 in each row of the anode A part are drawn from left end. On the other hand, common anode terminals $P_{1B}$~$P_{(4\times m)B}$ connecting each of the like arrangement numbers 1 to 4 in each row of the anode B part are drawn from right end.

Figure 2:
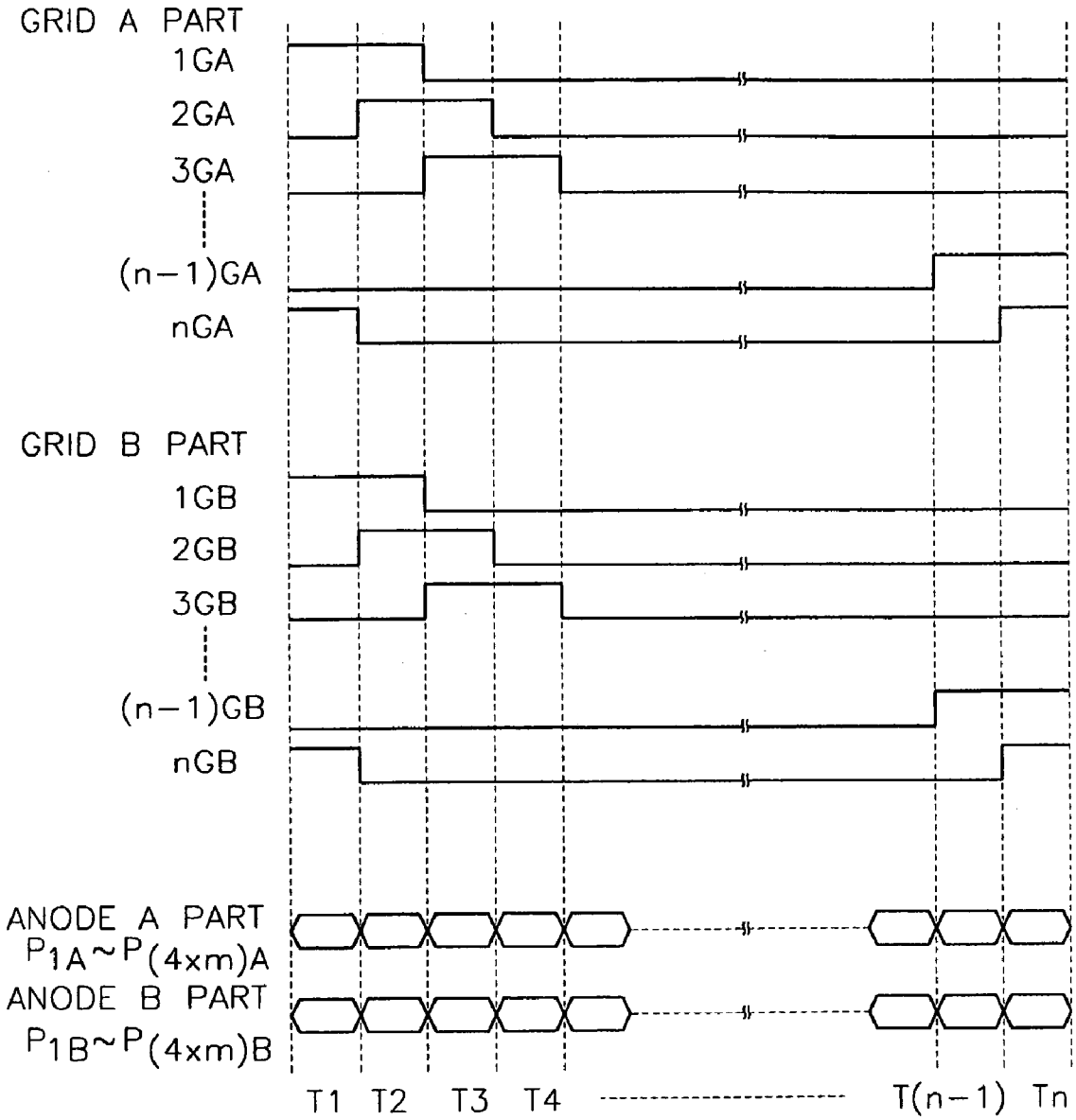
FIG. 2 presents a timing chart showing a manner of driving of the multiplex anode matrix vacuum fluorescent display in accordance with present invention.

FIG. 2 is a timing chart showing a manner of driving of the multiplex anode matrix fluorescent display in accordance with the present invention.

Figure 3:
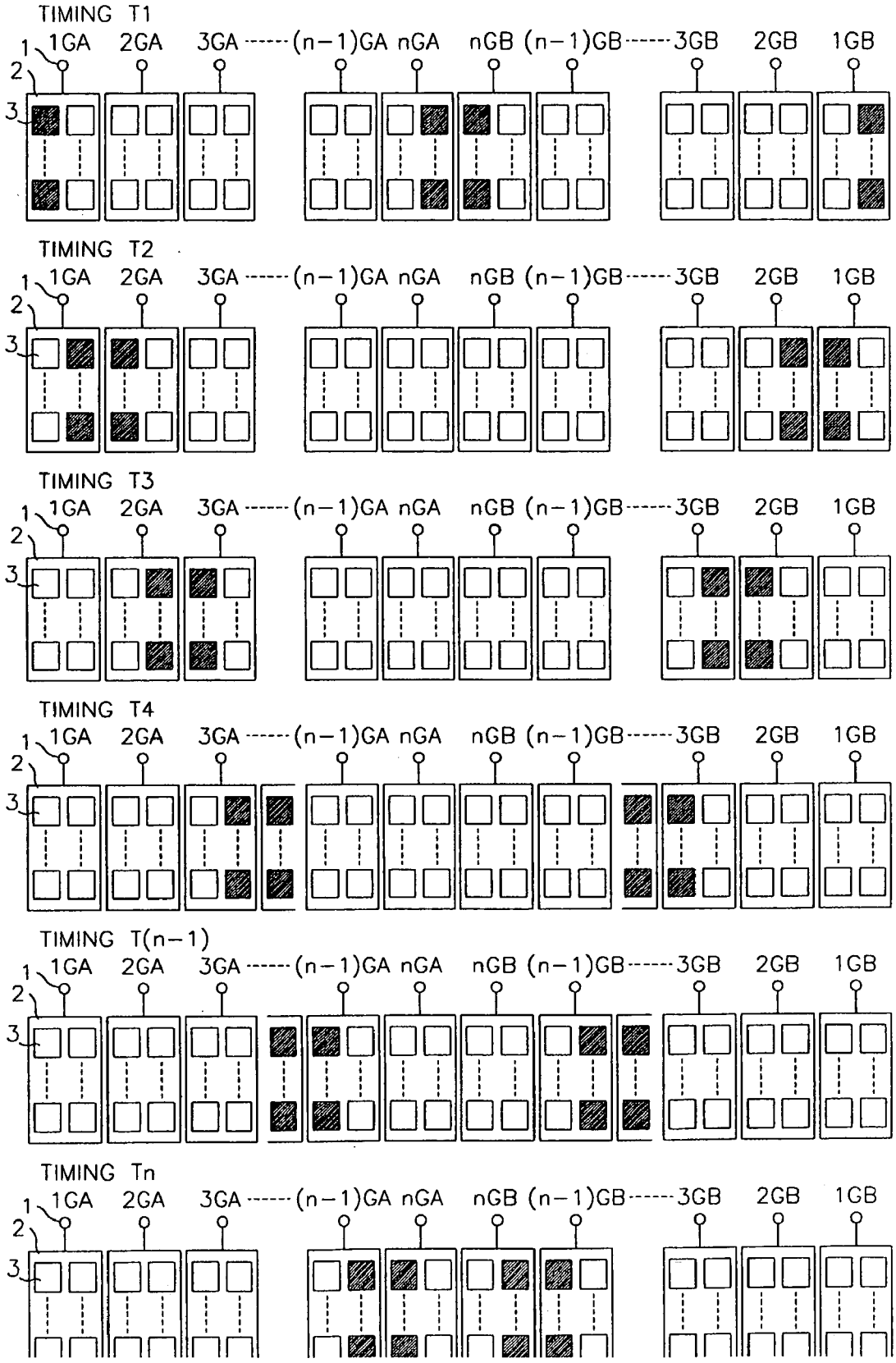
FIG. 3 provides an exemplary diagram showing a manner of driving light segments in the multiplex anode matrix vacuum fluorescent display in accordance with the present invention.

FIG. 3 is an exemplary diagram showing a manner of driving light segments in the multiplex anode matrix vacuum fluorescent display in accordance with the present invention.

FIG. 2 is explained hereinafter with reference to a displaying state of FIG. 3, wherein a grid driver carries out grid scanning. Grid scanning starts from two adjacent grids 1GA, nGA in the grid A part and from two adjacent grids 1GB, nGB in the grid B part and proceeds grid by grid toward central portion of the fluorescent display by applying a driving pulse.

On the other hand, although an anode pulse voltage corresponding to displaying data is applied to each anode electrode 3 in a similar manner to that of a prior art, an anode voltage according to each segment of the anode electrodes 3 capable of controlling displaying thereof is applied to each of the anode A part and the anode B part. That is, an anode driver applies an anode voltage to the anode terminals $P_{1A}$~$P_{(4\times m)A}$, the anode terminals $P_{1B}$~$P_{(4\times m)B}$ and two columns of anode electrodes 3 located at the central portion of the adjacent grid electrodes 2 where a grid driving pulse is applied.

And the meaning of adjacent is adjacent in the sense of scanning. For example, in the grid A part, the grid electrode 2 connected to the grid electrode number nGA is adjacent to the grid electrode 2 connected to the grid electrode number 1GA, wherein a driving pulse voltage is applied periodically. Similarly, in the grid B part, the grid electrode 2 connected to grid electrode number 1GB is adjacent to the grid electrode 2 connected to the grid electrode number nGB.

In the illustrated example, the grid A part is driven by scanning a grid electrode by a grid electrode in the right direction and the grid B part is driven by scanning a grid electrode by a grid electrode in the left direction.

At this time, in FIG. 3, the displaying segments proceed to the right direction column by column from timing T1 to timing Tn in the left area A. Simultaneously, the displaying segments proceed to the left direction column by column from timing T1 to timing Tn in the right area B. The timing Tn returns to the timing T1.

When a driving pulse voltage is applied to each of the grid A part and grid B part periodically, driving pulse voltages are simultaneously applied to the grid electrode nGA of the grid A part and the grid electrode nGB of the grid B part, being adjacent to each other on the border of the areas A, B. In FIG. 3, this timing is T1.

That is, in the adjacent border of areas A, B, when the grid driver and the anode driver drive the grid electrode nGA in the end of the area A and at the same time, the anode electrodes 3 in the end of the area A is displayed, the grid electrode nGB in the end of the other area B is driven and the anode electrodes 3 in the end of the other area B is displayed simultaneously, wherein the scan timing of the grid driving pulse starts at the same time in both area.

Otherwise, at the border line between the area A and the area B in the central portion of the fluorescent display, the segment dots of the right half anode electrode columns of the grid electrodes nGA and the left half anode electrode columns of the grid electrode nGB cannot be controlled as in the conventional quadruple anode matrix display. If the synchronization is not achieved, the characters will be broken at the center portion.

Even in the single matrix fluorescent display, if the area is divided into two portions, the single matrix fluorescent display can be driven by applying a driving pulse voltage to the grid electrodes in each area periodically as described above But, in the quadruple anode matrix display, only when the study described above is utilized in the column drive of the anode electrodes in the border area, it is possible to implement the driving of two areas of parts A, B at the same time.

As described above, by dividing the segment pattern area into two portions, the number of the terminal electrodes becomes half that of the prior art quadruple anode matrix display and the duty cycle thereof becomes equal to two times that of the prior art quadruple anode matrix display. Although the number of the anode terminals is increased by two times, since the number of the wiring remains to be equal to that of the prior art, it is possible to construct the fluorescent display having a same number of the segments and a same pitch as the prior art. In other words, in accordance with the present invention, the quadruple anode matrix fluorescent display can obtain the same circuit characteristics equivalent to those of an octuple anode matrix fluorescent display without changing it's size.

Therefore, if the brightness is maintained to be equal to that of the prior art quadruple anode matrix fluorescent display, the voltage of the anode and the grid electrode can be lowered. If the duty cycle is increased by two times, the applying voltage can be reduced to about 1/1.3. These characteristics make the present invention be readily adaptable to a graphic display for use in a mobile for which it is difficult to supply a high voltage. Anode and grid drivers of low withstand voltages can also be used, facilitating the construction of a fluorescent display of a CIG (chip in glass) or a COG (chip on glass) type. The CIG means that the driver IC is mounted on a glass substrate located inside the vacuum envelope of the fluorescent display and the COG means that the driver IC is mounted on a glass substrate located outside the vacuum envelope of the fluorescent display. For such a driver IC, it is difficult to raise the withstand voltage thereof.

In comparison with the prior art octuple anode matrix fluorescent display producing a same brightness, in accordance with the preferred embodiment of the present invention, an anode wiring pattern in the segment pattern area is equivalent to that of the quadruple anode, the characteristics of the prior art octuple anode matrix display can be implemented with the same dot pitch and the same dot size of the prior art quadruple anode matrix display, to thereby achieve a high density and a small size thereof without increasing the ratio of the area occupied by the aluminum wirings.

On the other hand, if the grid driving voltage of the quadruple anode matrix fluorescent display in accordance with present invention is set to be equal to that of the prior art quadruple anode matrix fluorescent display, the brightness obtained will be increased.

In the explanation described above, although the preferred embodiment is explained with reference to the quadruple anode matrix fluorescent display, it can be modified to a fluorescent display having larger than octuple anode electrodes. In other words, a duty cycle in accordance with a sixteen fold anode matrix fluorescent display can be obtained by changing the applying method of the displaying data. However, according to the degree of the multiplex, e.g., in the triple anode matrix fluorescent display, the wirings from the anode electrodes to the anode terminals must be changed.

Next, an implementing method for applying the driving pulse voltage will be explained with reference to FIG. 2. As apparent from FIG. 2, a driving pulse applied to a grid electrode in the grid A part is same as that applied to a corresponding grid electrode in the grid B part. That is, pairs of corresponding grid electrode numbers are 1GA and 1GB, 2GA and 2GB, . . . , nGA and nGB.

A first implementing method is a method to write a wiring pattern on a substrate located in a vacuum envelope of a fluorescent display. This grid wiring pattern is to connect grid electrodes located at the same location according to each grid electrode in the part A and the part B to a common grid terminal, respectively.

A second method is to interconnect each grid wiring so as to connect each grid electrode to a corresponding common grid terminal by a jump wiring in a print wiring portion on a glass substrate of the fluorescent display, which is being employed outside the vacuum envelope of a fluorescent display.

In the first and the second method, a grid driver applies a scan pulse to the grid electrodes.

A third method is a method synchronously applying a scan pulse to grid electrodes of the grid A part and to those of the grid B part by separate drivers, respectively.

In either case, the anode driver supplies an anode voltage corresponding to displaying data in connection with the scan pulse to anode electrodes located at displaying position in each of the anode A part and the anode B part. Although the number of anode electrodes to which anode voltages are independently applied at the same time is increased by two times, it can be easily manufactured by the above-described COG or CIG structure.

FIG. 4 is a concept diagram showing a manner of scanning the multiplex anode matrix fluorescent display in accordance with present invention. FIG. 4A conceptually describes a first scanning method shown in FIGS. 2 and 3. FIGS. 4B, 4C and 4D represent a second to a fourth scanning methods.

Figure 4A:
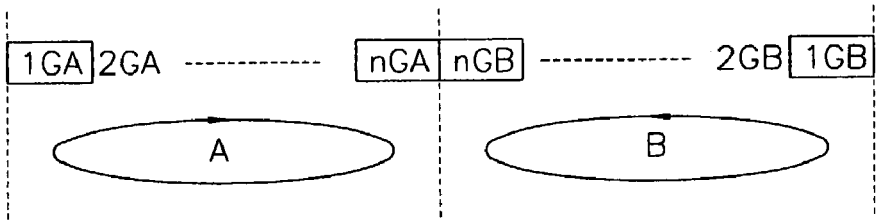
FIGS. 4A to 4D depict concept diagrams showing manners of scanning the multiplex anode matrix vacuum fluorescent display in accordance with present invention, respectively.

In FIG. 4A, the left side is a symbol column of the grid electrodes belonging to the grid A part and the right side is a symbol column of the grid electrodes belonging to the grid B part. The symbols 1GA, nGA, nGB, 1GB encompassed with rectangular are the grid electrodes, respectively, to which grid driving pulse is applied when each of electrode columns is simultaneously displayed at the border between the area A and the area B.

Although the grid A part and the grid B part switch the grid electrodes applying grid driving pulses electrode by electrode progressively, the scan periods thereof are equal to each other. The scan direction in the grid A part is to the right direction, while that in the grid B part is to the left direction. If one period of the scan is passed, the state of scanning returns back as shown in drawings.

Figure 4B:
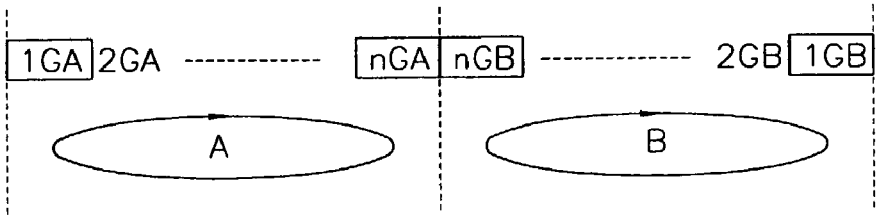

A second method shown in FIG. 4B makes the scan directions of the grid A part and the grid B part same. In this method, if a scan cycle becomes synchronous so that each of anode electrode columns in the border between the grid A part and the grid B part is displayed simultaneously, it becomes an octuple anode matrix display in view of driving circuit.

Figure 4C:
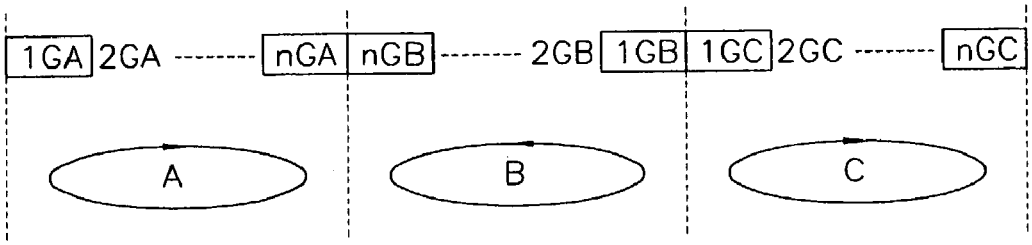
Figure 4D:
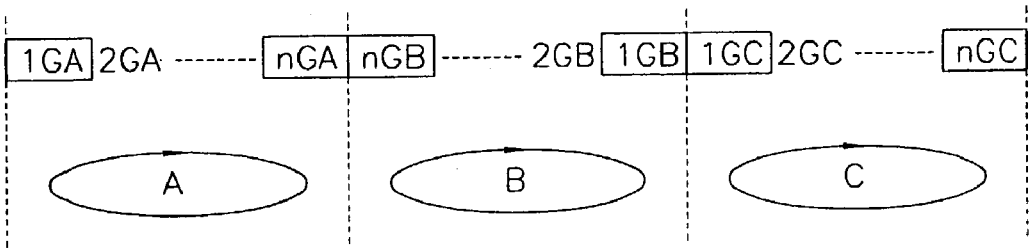

The third and the fourth methods shown in FIGS. 4C and 4D, respectively, are to divide the grid electrodes into three parts, e.g., grid A to C parts. The symbols 1GA, nGA, nGB, 1GB, 1GC, nGC encompassed with rectangular are the grid electrodes to which grid driving pulse is applied when each of electrode columns is simultaneously displayed at the border between the area A, the area B and the area C. As shown in the drawings, the scan direction can be arbitrary.

And thus, although the grid electrodes consist of three parts, by making a scan cycle synchronous such that each of anode electrode columns in the adjacent border areas can be simultaneously displayed, it becomes a twelve fold (quadruple×3) anode matrix display in view of driving circuit. In this way, by increasing the number of areas A, B to the number of areas A, B, C . . . , the number of the dots in the direction of row (in the longitudinal direction) allows to realize the multiplex of the fluorescent display.

For example, the area is divided into five parts, wherein each part is driven by a controlled river. 40 dots (column direction)×160 dots (row direction) of the anode and the grid electrodes are driven by a control driver and the display of 40 dots (column direction)×800 dots (row direction) are driven by the five control drivers.

The example described above is a case when the numbers of the grid electrodes are equal to each other in each grid part. In case when the numbers of the grid electrodes are different in each grid, imaginary grid electrodes, which do not exist in reality, can be allocated in the scanning period. For example, it may be assumed that the imaginary grid electrodes are not connected to the output terminals of the driver for use in scanning.

Due to the change in the scanning method in accordance with the present invention illustrated with reference to FIG. 4 from a scan method of a single grid part in the prior art quadruple anode matrix fluorescent display, the output order of the displaying data driving the anode electrode columns will be significantly changed. In addition to a grid driver supplying grid voltages to grid terminals by inputting scan pulse signals and an anode driver supplying anode voltages in response to the display data, a control driver to drive the fluorescent display for use in displaying is added, wherein the drivers include CPU, ROM and displaying RAM and the like. The displaying data and the data to be used to scan the grids are stored into the displaying RAM. Therefore, since the CPU can control the fluorescent display in accordance with the control program stored in the ROM, it is possible to implement the scanning method in accordance with the present invention by changing the program stored in the ROM.

In the explanation described above, the grid electrodes are assumed to be in the form of metal mesh. However, it is possible for the grid electrode to have another structure.

Figure 5A:
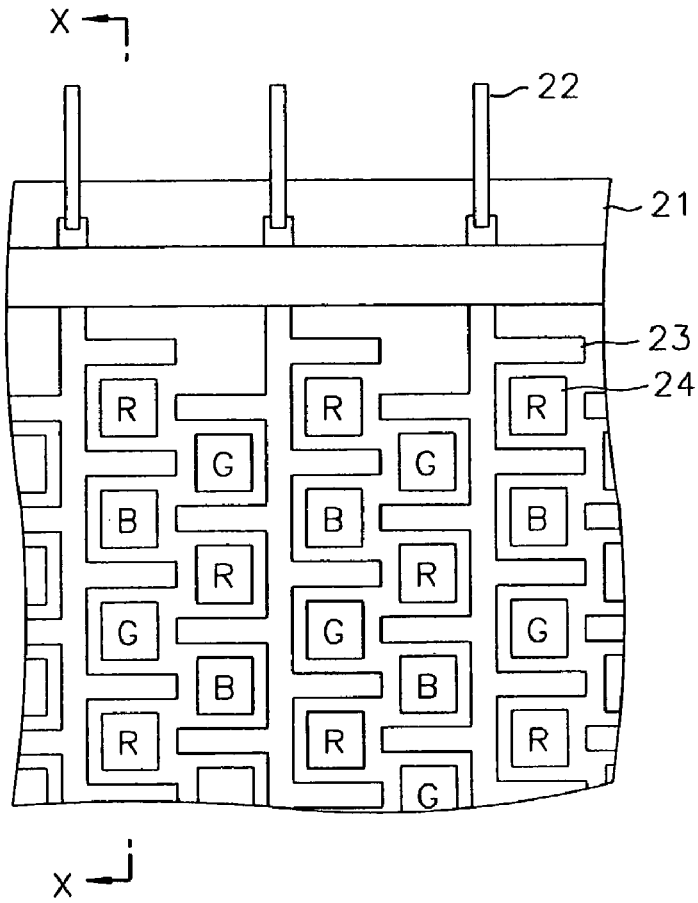
FIGS. 5A and 5B represent exemplary diagrams showing a bulkhead grid in accordance with a first preferred embodiment of the present invention.
Figure 5B:
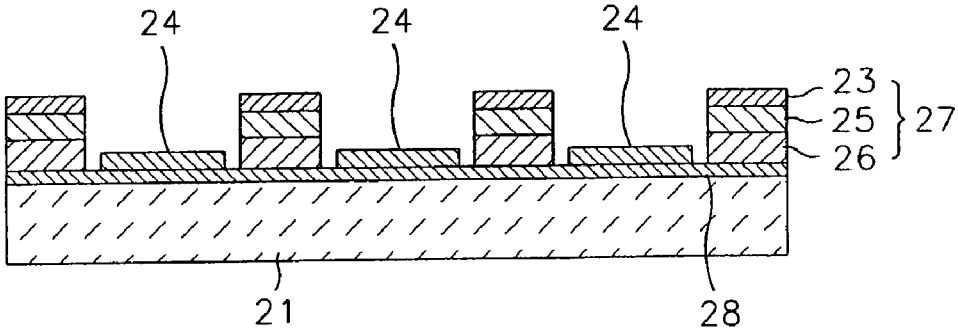

FIG. 5 is an exemplary diagram showing a bulkhead grid in accordance with a first preferred embodiment. FIG. 5A is a plan view showing a major part of the fluorescent display and FIG. 5B is a cross-sectional view taken along a line X—X.

In the drawings, a reference numeral 21 represents a substrate, a reference numeral 22 represents a grid terminal, a reference numeral 23 represents a grid conductor layer, a reference numeral 24 represents a phosphor layer, a reference numeral 25 represents an anti-electrical charge resistor layer, a reference numeral 26 represents an insulating layer, a reference numeral 27 represents a bulkhead grid and a reference numeral 28 represents a conducting layer.

On the substrate 21, the conducting layer 28 which is consisted of the anode electrodes or the wiring conductors is formed in the shape of a pattern. Although the detailed description of the pattern is omitted, the pattern is buried in such a way that the anode conductors are in the form of a quadrangle or an annular. The bulkhead grid 27 is formed on a region separated from but near to the peripheral of the anode conductor. This bulkhead grid 27 has branch portions alternately at a right and a left side of a body portion in the top and bottom direction as shown and the anode conductors are located at the right and the left side, respectively.

As shown in FIG. 5B, this bulkhead grid 27 is a three layer formed of the insulating layer 26 formed on top of the conducting layer 28, the anti-electrical charge resistor layer 25 and the grid conductor layer 23 and its height is higher than that of the phosphor layer 24 formed on top of the anode conductor.

As a result, the anode conductor forming the phosphor layer 24 is encompassed with the bulkhead grid in three sides. The phosphor layer 24 emits light of color R, G, B, and the phosphor layers emitting a same color are arranged in a row direction and each of the anode conductors located thereunder is connected to a wiring conductor. In the column direction, the phosphor layers emitting the three colors of R, C, B are arranged in the shape of a zigzag. This bulkhead grid 27 can be utilized as a grid electrode in a quadruple anode matrix fluorescent display. When the grid voltage is applied to two columns of the adjacent bulkhead grid 27, the anode wiring conductor is formed in order to control two columns of the anode conductor to be displayed.

Figure 6:
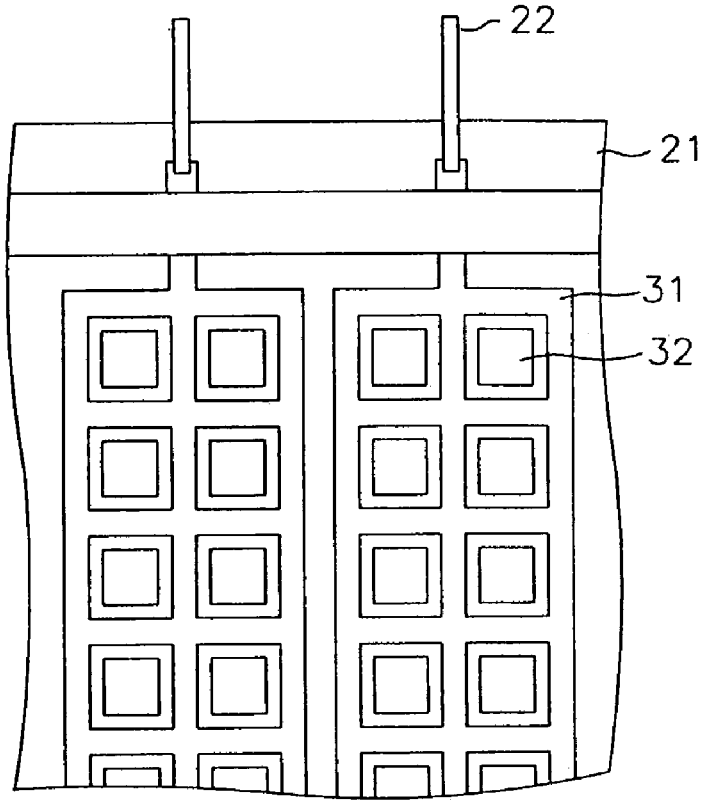
FIG. 6 presents an exemplary diagram showing a bulkhead grid in accordance with a second preferred embodiment of the present invention.

FIG. 6 is an exemplary diagram showing a bulkhead grid in accordance with a second embodiment. In the drawing, like parts appearing in FIG. 5 are represented by like reference numerals and the explanation therefor will be omitted. A reference numeral 31 represents a grid conductor layer and a reference numeral 32 is a phosphor layer. Although the explanation of the like reference numerals is omitted, the grid conductor layer 32 is formed in such a way that its height is higher than that of the phosphor layer 31 formed on top of the anode conductor layer by e.g., the insulating layer, as similar to that of FIG. 5. Alternatively, this bulkhead grid is arranged in such a way that two columns of hole portions in the form of a rectangular envelope are formed at the right and the left side of the body portion in the longitudinal direction.

As a result, the anode conductor forming the phosphor layer 32 is encompassed with the bulkhead grids in four sides.

As is apparent from the above described explanation, in the multiplex anode matrix fluorescent display in accordance with the present invention, the number of the grid becomes half that of the conventional case in view of a driving circuit and the duty cycle thereof becomes large. As a result, same brightness to that produced from display in accordance with the prior art can be obtained by applying much lower driving voltage. In other word, the duty cycle basically depends on the number of the grids or equivalently on the number of dots in the longitudinal direction of a graphic VFD. Therefore, if the driving voltage is kept under a predetermined value while maintaining the brightness equivalent to that of the prior art, the number of dots in the longitudinal direction of the graphic VFD will have a limit. In accordance with the present invention, in the fluorescent display, the number of dots in the longitudinal direction can be increased to many times the limit mentioned above.

Also, since the number of wirings can be reduced in the pattern areas while achieving the same brightness obtained from the prior art large multiplex anode matrix fluorescent display, a compact fluorescent display with a high definition of the dot pitch can be realized.

While the present invention has been described with respect to the preferred embodiments, other modifications and variations may be made without departing from the spirit and scope of the present invention as set forth in the following claims.

What is claimed is:

1. A multiplex anode matrix fluorescent display comprising:

a plurality of anode electrodes and a multiple number of grid electrodes arranged in a form of a matrix, the grid electrodes being arranged in such a way that k column of the anode electrodes corresponds to each grid electrode, k being an even positive integer, and the anode electrodes and the grid electrodes being divided into a number of regions in the direction of row;

separate anode wirings formed on each of the regions; and a grid driver and an anode driver, wherein the grid driver simultaneously applies a driving voltage to two columns of adjacent grid electrodes in each of the regions by scanning the grid electrodes in a row direction, the anode driver activates a plurality columns of anode electrodes located at the two adjacent grid electrodes, to which the driving voltage is applied.

2. The display of claim 1, wherein, at a border line between two adjacent regions, the grid driver and the anode driver make synchronous scan cycles of a grid driving pulse in the adjacent regions, respectively so that a first grid electrode and a first node electrode located at one end of one of the two adjacent regions are simultaneously driven with a second grid electrode and a second anode electrode positioned at one end of the other of the two adjacent regions, the first grid and the first anode electrodes being disposed adjacent to the second grid and the second anode electrodes, respectively.

3. A method for use in a multiplex anode matrix fluorescent display including a plurality of anode electrodes and a multiple number of grid electrodes arranged in a form of a matrix, the grid electrodes being arranged in such a way that k column of the anode electrodes corresponds to each grid electrode, k being an even positive integer, and the anode electrodes and the grid electrodes being divided into a number of regions in the direction of row; separate anode wirings formed on each of the regions; and a grid driver and an anode driver, wherein the grid driver simultaneously applies a driving voltage to two columns of adjacent grid electrodes in each of the regions by scanning the grid electrodes in a row direction, the anode driver activates a plurality columns of anode electrodes located at the two adjacent grid electrodes, to which the driving voltage is applied.

4. The method of claim 3, wherein, at a border line between two adjacent regions, the grid driver and the anode driver make synchronous scan cycles of a grid driving pulse in the adjacent regions, respectively so that a first grid electrode and a first node electrode located at one end of one of the two adjacent regions are simultaneously driven with a second grid electrode and a second anode electrode positioned at one end of the other of the two adjacent regions, the first grid and the first anode electrodes being disposed adjacent to the second grid and the second anode electrodes, respectively.

5. An anode matrix fluorescent display, comprising:

a plurality of anode electrodes linearly arranged, the anode electrodes being divided into a number of sectors each of which includes successive anode electrodes and is divided into a multiplicity of groups, each of the groups having two sections each of which contains k anode electrodes, k being an even positive number;

a number of separated anode wirings, each anode wiring being provided to one of the sectors; and a grid electrode provided to each section, wherein anode electrodes disposed at a same position in the respective groups of each sector are electrically connected to each other by a corresponding anode wiring and 2k anode electrodes in each group are independently driven from each other;

a grid driver for simultaneously applying a driving voltage to drive grid electrodes of two adjacent sections disposed in each sector by scanning grid electrodes one by one; and an anode driver for simultaneously driving only k anode electrodes disposed at the center of the two adjacent sections.

6. The anode matrix fluorescent display of claim 5, wherein a grid electrode and k/2 anode electrodes in a section located at one end of a sector are driven simultaneously with a grid electrode and k/2 anode electrodes of a section located at the other end of the sector, and wherein a first grid electrode and a first anode electrode located at one end of one of two neighboring sectors are simultaneously driven with a second grid electrode and a second anode electrode positioned at one end of the other of the two neighboring sectors, the first grid and the first anode electrode being disposed adjacent to the second grid and the second anode electrode, respectively.

7. The anode matrix fluorescent display of claim 5, wherein grid and anode electrodes disposed in one of two neighboring sectors are sequentially driven in a first direction, and grid and anode electrodes arranged in the other of the two neighboring sectors are sequentially driven in a second direction.

8. The anode matrix fluorescent display of claim 7, wherein the first and the second direction are identical.

9. The anode matrix fluorescent display of claim 7, wherein the first and the second direction are opposite to each other.

* * * * *